US010233702B2

(12) United States Patent
Hackl et al.

(10) Patent No.: US 10,233,702 B2
(45) Date of Patent: Mar. 19, 2019

(54) DEVICE AND METHOD FOR CLEANING OR LUBRICATING OF DRILL ROD ELEMENT AND DRILLING RIG

(71) Applicant: BAUER Deep Drilling GmbH, Schrobenhausen (DE)

(72) Inventors: Stefan Hackl, Aichach (DE); Pedro Dias, Munich (DE); Manuel Ostermeier, Pobenhausen (DE)

(73) Assignee: BAUER Deep Drilling GmbH, Schrobenhausen (DE)

( * ) Notice: Subject to any disclaimer, the term of this patent is extended or adjusted under 35 U.S.C. 154(b) by 136 days.

(21) Appl. No.: 15/360,237

(22) Filed: Nov. 23, 2016

(65) Prior Publication Data

US 2018/0142523 A1 May 24, 2018

(51) Int. Cl.

| | |
|---|---|
| ***B08B 1/00*** | (2006.01) |
| ***B08B 3/02*** | (2006.01) |
| ***B08B 7/04*** | (2006.01) |
| ***B08B 9/02*** | (2006.01) |
| ***E21B 17/00*** | (2006.01) |
| ***E21B 19/00*** | (2006.01) |

(52) U.S. Cl.

CPC ..... *E21B 19/00* (2013.01); *B08B 1/002* (2013.01); *B08B 3/022* (2013.01); *B08B 7/04* (2013.01); *B08B 9/02* (2013.01); *E21B 17/006* (2013.01)

(58) Field of Classification Search

CPC ..... B08B 1/002; B08B 3/022; B08B 7/04; E21B 19/00; E21B 17/006

See application file for complete search history.

(56) References Cited

U.S. PATENT DOCUMENTS 2,305,079 A * 12/1942 Heldenbrand ..... E21B 17/006 15/104.04
2,682,068 A * 6/1954 Harrigan ..... E21B 17/006 15/104.04
5,052,422 A * 10/1991 Franz ..... B08B 3/02 134/104.2
6,589,343 B1 * 7/2003 Egeland ..... E21B 17/006 118/313

FOREIGN PATENT DOCUMENTS

WO 2005/093203 A1 10/2005
WO WO-2005093203 A1 * 10/2005 ..... E21B 17/006

* cited by examiner

*Primary Examiner* — James G Sayre
(74) *Attorney, Agent, or Firm* — Studebaker & Brackett PC

(57) ABSTRACT

The invention relates to a device and a method for cleaning or lubricating at least a connecting section of a drill rod element, with a housing, a channel-like recess and at least one washing means or lubricating means which is arranged along the channel-like recess. The channel-like recess is designed for horizontal insertion of at least a lower connecting section of the drill rod element when the drill rod element is substantially in vertical alignment. The invention further relates to a drilling rig with the said device for cleaning or lubricating.

12 Claims, 4 Drawing Sheets

DEVICE AND METHOD FOR CLEANING OR LUBRICATING OF DRILL ROD ELEMENT AND DRILLING RIG

FIELD OF THE INVENTION

The invention relates to a device for cleaning or lubricating at least a connecting section of a drill rod element with a housing and at least one washing means or lubricating means which is arranged in the housing.

The invention further relates to a method for cleaning or lubricating at least a connecting section of a drill rod element, wherein a lower connecting section of a vertically arranged drill rod element is cleaned by means of a washing means or lubricated by means of a lubricating means.

The invention further relates to a drilling rig with a drill mast, along which a drill rod element can be drilled into the ground by means of a drill drive while a borehole is being formed and withdrawn again from the borehole after production of the bore.

BACKGROUND OF THE INVENTION

From WO 2005/093203 A1 an automatic cleaning device for drill rods is known. This device has a housing with an upper entry opening. Through the upper entry opening vertically arranged drill rod elements can be inserted from above with a lower connecting section into the housing of the washing device. On insertion an actuating plate is pressed downwards, whereby the washing means and in particular washing nozzles are put into operation.

This known automatic washing means requires a reliable control depending on the length of the drill rod element. When using drill rod elements of greater length there is a risk that these hit the bottom of the housing which can lead to damage on the device or the drill rod element.

SUMMARY OF THE INVENTION

The invention is based on the object to provide a device and a method for cleaning or lubricating a connecting section of a drill rod element, with which a drill rod element can be cleaned or lubricated reliably and efficiently.

Furthermore, the invention is based on the object to provide a drilling rig which allows efficient cleaning or lubrication of the drill rod elements.

According to the invention the stated object is achieved on the one hand by a device for cleaning or lubricating at least a connecting section of a drill rod element, with a housing, a channel-like recess which extends from at least one side opening in at least one side wall of the housing in a horizontal direction along an upper side of the housing and is designed for receiving at least a connecting section of the drill rod element, and at least one washing means or lubricating means with at least one washing nozzle which is arranged along the channel-like recess, wherein the channel-like recess is designed for horizontal insertion of at least a lower connecting section of the drill rod element when the drill rod element is substantially in vertical alignment.

A basic idea of the invention lies in the abandonment of barely a vertical insertion of the drill rod element into a cleaning device. In fact, according to the invention a housing with a channel-like, substantially horizontally running recess is provided which has at least one side opening in at least one side wall of the housing. This permits that at least the connecting section of a drill rod element, when located in a vertical arrangement, can be pivoted laterally and in the horizontal direction into the housing. In this way, the risk of damage to the housing is reduced even in the case of different drill rod lengths. Moreover, depending on the length of the channel-like recess one or several washing means and/or lubricating means can be arranged. Through horizontal movement of the drill rod element along the recess an efficient cleaning or lubrication at least of the connecting section of the drill rod element can thus take place.

A preferred embodiment of the device according to the invention resides in the fact that on the channel-like recess a switch means is provided, by which, on entry of the drill rod element into the recess, the washing means or lubricating means is switched on and, on exit, is switched off again. Thus, the means is only put into operation if a drill rod element is actually located in the housing of the cleaning device. As a result, energy and cleaning fluid, more particularly water, can be saved.

According to a preferred further development of the invention it is advantageous that the switch means has at least one adjustably supported actuating bar which is adjustable between a switch-off position in the region of the recess and a switch-on position, wherein in the switch-on position the washing means or lubricating means is switched on and in the switch-off position is switched off again. In the switch-off position the actuating bar reaches into the region of the recess. Through entry of the drill rod element the actuating bar is moved from the switch-off position into a switch-on position, in which the actuating bar no longer obstructs the drill rod element. On reaching the switch-on position, the washing means or lubricating means is put into operation. By preference, the actuating bar is spring-pre-tensioned so that when the drill rod element exits from the recess the actuating bar is pivoted from the switch-on position back into the switch-off position. Through this, the means is put out of operation again.

According to a further advantageous embodiment variant of the invention provision is made in that at least two actuating bars are arranged which each run on one side along the channel-like recess. The actuating bars therefore run substantially parallel to the channel-like recess. This has the advantage that even in the case of a greater length of the channel-like recess of 1 m and more the actuating bars are pressed at each point of the channel-like recess into the switch-on position by the drill rod element. Through the arrangement of two actuating bars a reliable actuation of the washing means is ensured.

By preference, the actuating bars are supported under spring pre-tension, wherein through the spring pre-tension the actuating bar is pressed into the switch-off position. Hence, when the drill rod element exits from the recess of the housing the actuating bars are pressed back into the region of the channel-like recess into the switch-off position. As a result, the operation of the washing means is stopped and therefore also the use of cleaning fluid.

Furthermore, according to an embodiment variant of the invention it is advantageous that on entry of the drill rod element into the channel-like recess the actuating bars are adjusted from the switch-off position into the switch-on position. Thus, when the drill rod element enters the recess in the housing the washing means is reliably put into operation.

Basically, the washing means can be designed in any chosen way and have various types of cleaning elements. According to a further development of the invention it is especially advantageous that the washing means has at least one washing nozzle which is designed to direct a cleaning jet of a cleaning fluid onto the drill rod element. By means of the washing nozzle in particular a cleaning fluid, especially water, can be directed at high pressure onto the drill rod element. In this way, especially a connecting region of the drill rod element with a delicate thread can be cleaned reliably from adhering dirt or earth. This reduces the risk of corrosion as well as damages or problems occurring during a renewed connection of the drill rod elements.

According to a further embodiment of the invention it is advantageous for a good cleaning result that the washing means has at least one brush driven in a rotating manner for cleaning the drill rod element. In this way, a mechanical cleaning can be effected alternatively or additionally to the cleaning with a cleaning jet. By preference, several rotating brushes are provided which act upon and clean the drill rod element from two sides.

Another preferred embodiment variant of the invention resides in the fact that the lubricating means has at least one application unit for applying a lubricant at least to the connecting section of the drill rod element. The lubricant can be a lubricating grease or a lubricating oil. To this, a corrosion inhibitor is preferably added. By way of the lubricant not only a simple corrosion protection but also a facilitated screwing of the drill rod elements in a further drilling operation can be achieved. The lubricating means can have nozzles for spraying on the lubricant or other application bodies such as brushes, application doctor blades etc. The lubricating means can be provided as an alternative or by preference as a supplement to the washing means.

Basically, the elongate or channel-like recess along the upper side of the housing of the device according to the invention can be designed in a linear or arched manner. Advantageously, the recess extends transversely across the housing from a first opening in a first side wall to an opening in a second side wall, wherein on entry of the drill rod element into the recess through the first opening the washing means is actuated and on exit from the second opening the washing means is switched off and wherein on entry of the drill rod element into the recess through the second opening the lubricating means is actuated and on exit from the second opening the lubricating means is switched off again. Thus, the drill rod element can run through the housing on a transport path. The device can therefore be arranged e.g. on a transport path between a drill mast and a drill rod magazine. Through this, a transport path as well as the handling time required for removing the drill rod elements is reduced. On the way from the drill mast to the magazine the washing means can be actuated, whereas on the way from the magazine to the drill mast the lubricating means is activated.

The object stated above is furthermore achieved by a drilling rig with a drill mast, along which at least one drill rod element can be drilled into the ground by means of a drill drive while a borehole is being formed and withdrawn from the borehole after production of the bore, wherein a handling means is provided, with which a withdrawn drill rod element can be received and transported away from the drill mast, wherein the previously described device for cleaning at least a connecting section of a drill rod element is provided. With the crane-like handling means a drill rod element can be gripped at its upper side and transported to a drill rod magazine. On the transport path at least the lower section of the drill rod element can run through the device and a lower connecting section can thereby be cleaned or lubricated efficiently.

With this drilling rig an efficient drilling method can thus be implemented since the drill rod elements can be cleaned reliably when being returned into the drill rod magazine and/or also lubricated when being transported to the drill mast.

The object stated beforehand can furthermore be achieved by a method for cleaning or lubricating at least a connecting section of a drill rod element, wherein a lower connecting section of a vertically arranged drill rod element is inserted through the at least one side opening in the at least one side wall of the housing into the channel-like recess which extends horizontally along an upper side of the housing, wherein in the channel-like recess at least the connecting section of the drill rod element is cleaned by means of a washing means or lubricated by means of a lubricating means. By way of the method according to the invention the advantages described beforehand in conjunction with the device can be attained.

An advantageous method variant of the invention resides in the fact that at least the connecting section of the drill rod element enters the channel-like recess through a first opening in a side wall of the housing and is moved and cleaned or lubricated along the channel-like recess, wherein the drill rod element exits from the channel-like recess at a second opening in a second side wall of the housing. In this way, the drill rod element can be moved in a substantially horizontal linear manner through the channel-like recess in the housing. Thus, cleaning or lubrication can take place directly on the transport path between drill mast and drill rod magazine.

In addition to cleaning the connecting section of the drill rod element it is advantageous according to a further development of the method pursuant to the invention that at least the connecting section of the drill rod element is provided with a lubricant after washing. For this purpose, washing means and lubricating means are combined.

BRIEF DESCRIPTION OF THE DRAWINGS

The invention is described further hereinafter by way of preferred embodiments illustrated schematically in the drawings, wherein show.

DETAILED DESCRIPTION OF PREFERRED EMBODIMENTS

Figure 1:
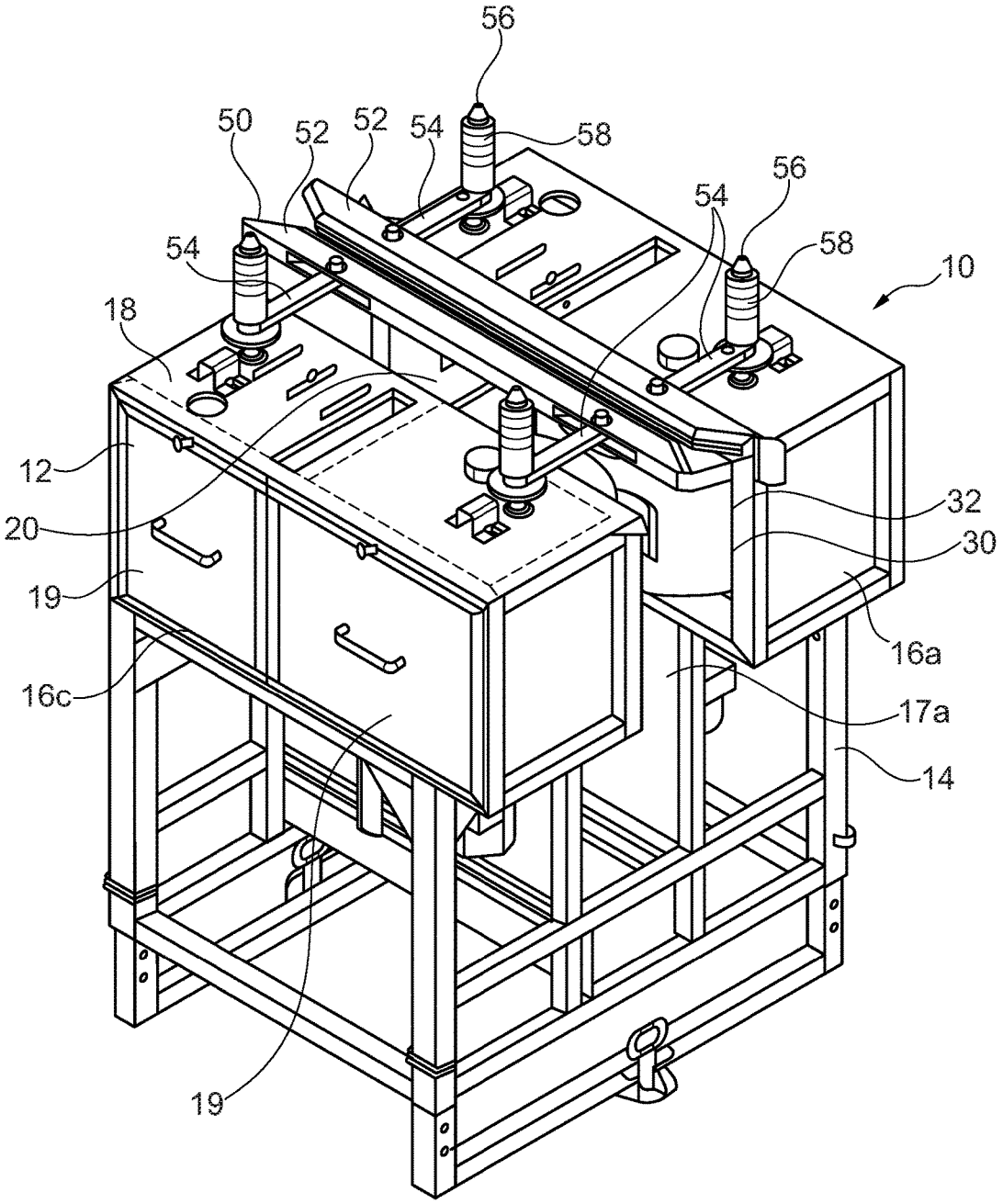
FIG. 1 a perspective view of a device for cleaning and lubricating according to the invention.
Figure 2:
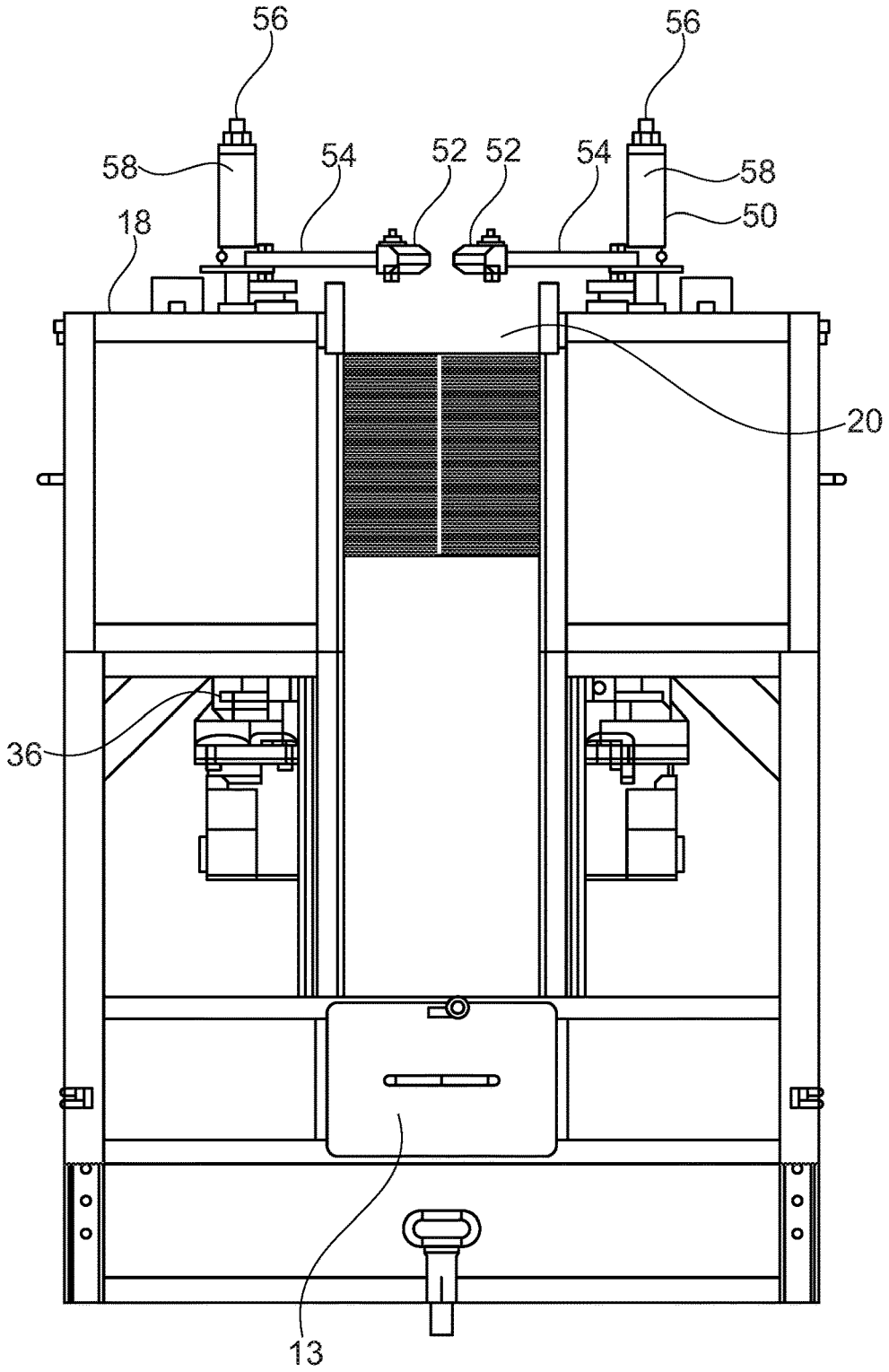
FIG. 2 a front view of the device of FIG. 1.
Figure 3:
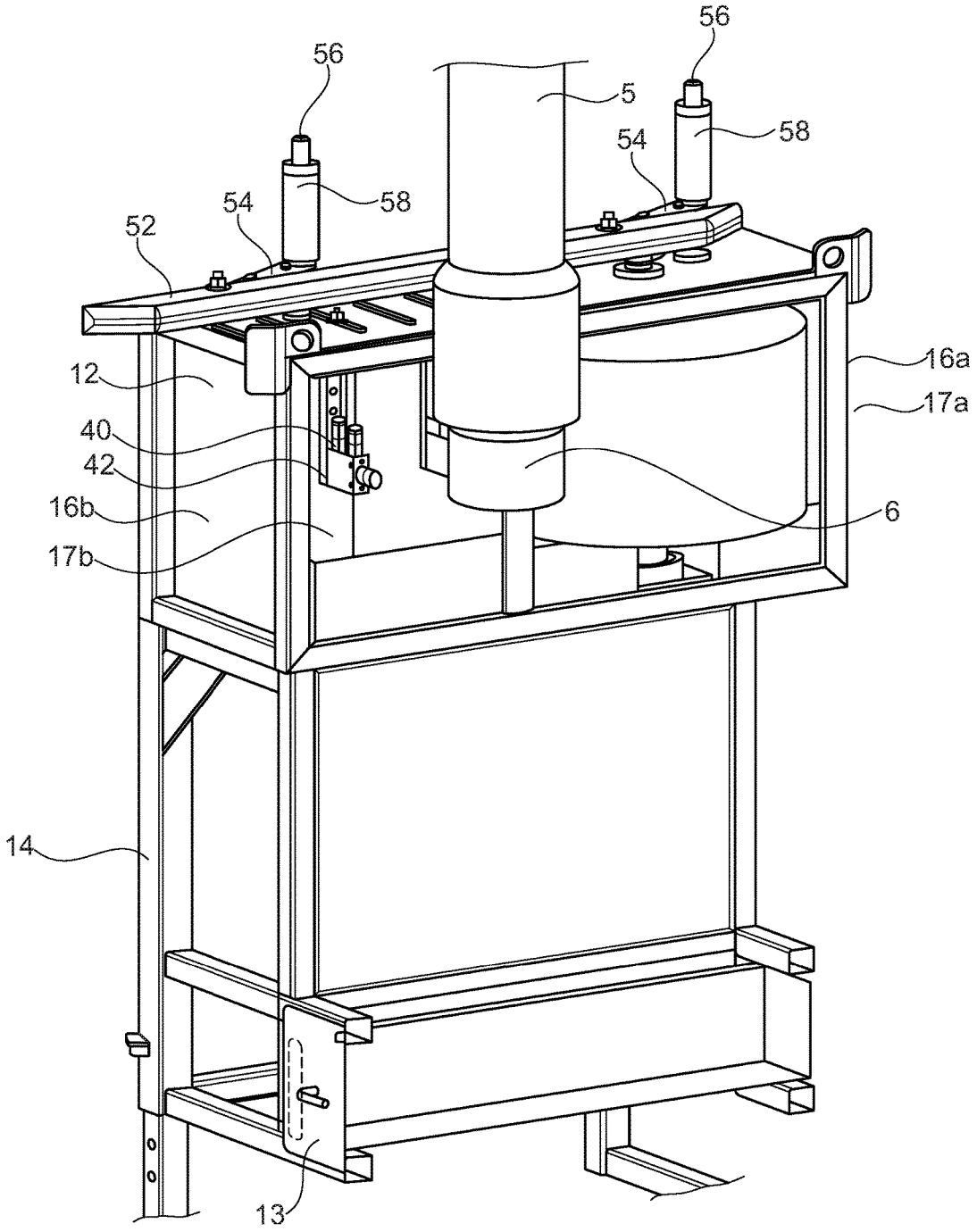
FIG. 3 a sectional perspective partial view of the device of FIGS. 1 and 2 with a partially depicted drill rod element.

According to FIGS. 1, 2 and 3 a device 10 according to the invention for cleaning and/or lubricating a drill rod element 5 with a lower connecting section 6 is provided. The device 10 has a box-shaped housing 12 on a framework 14. The housing 12 is formed of side walls 16*a*, 16*b* and an upper side 18. In a center region of the housing 12 a recess 20 runs from a frontal first side wall 16*a* with a central first opening 17*a* to a rear second side wall 16*b* with a central second opening 17*b*. The recess 20 is designed such that the connecting section 6 of a drill rod element 5 can be moved in a substantially horizontal manner through the channel-like recess 20 from the first opening 17*a* to the second opening 17*b* or vice versa.

Along the channel-like recess 20 a washing means 30 with two opposite brushes 32 is provided. The brushes 32 are each supported in a rotating manner about a vertically directed axis of rotation and driven in a rotating manner by a rotary drive 36 lying below. The washing means 30 is arranged close to the first opening 17*a* of the first side wall 16*a*.

Adjacent to the second opening 17*b* in the second side wall 16*b* a lubricating means 40 with a lubricating nozzle 42 is provided on either side of the channel-like recess 20. In the elongate side wall 16*c* of the housing 14 access doors 19 or drawers are arranged that allow access to the washing means 30 or lubricating means 40 from the side.

To activate or deactivate the washing means 30 or lubricating means 40 a switch means 50 is arranged on the upper side 18 of the housing 12. The switch means 50 has two actuating bars 52 arranged in parallel which extend above and along the channel-like recess 20. The actuating bars 52 are each linked to two horizontally directed pivot levers 54 which, in turn, are supported in a pivotable manner about a vertically directed pivot axis 56 each.

According to FIG. 1 and FIG. 2 the actuating bars 52 are located in a switch-off position above the recess 20, in which the washing means 30 and the lubricating means 40 are switched off. At their end regions the actuating bars 52 have lead-in inclinations. On horizontal insertion of a drill rod element 5, as shown in FIG. 3, the two actuating bars 52 are each pivoted towards the side about the pivot axes 56. Through this pivoting movement the switch means 50 activates the washing means 30 and the lubricating means 40. In the washing means 30 the brushes 32 are set into rotation, in which case a washing fluid can be applied additionally via a washing nozzle, not depicted. As a result, a connecting section 6 of the drill rod 5, in particular a thread region, is freed from adhering dirt after and/or before a drilling operation.

After the drill rod element 5 has run past the washing means 30 the connecting section 6 reaches the region of the lubricating means 40, in which a lubricating grease or lubricating oil is applied by means of a lubricating nozzle 42 from one or several sides onto the thread region. The lubrication can serve at the same time as corrosion protection for storage of the drill rod elements 5 in a drill rod magazine. The lubricating grease also facilitates a screwing-together of drill rod elements 5 to a drill string at a later stage. The washing means 30 and the lubricating means 40 can also be actuated in a time-shifted or differentiated manner.

On the pivot axes 56 tension housings 58 with an internal, non-depicted tension spring are provided in each case. During pivoting of the actuating bars 52 from the inward-lying switch-off position into the outward-lying switch-on position the tension springs in the tension housings 58 are tensioned. When the drill rod element 5 has exited from the second opening 17*b* in the second side wall 16*b* the actuating bars 52 are thus reset through spring tension from the switch-on position into the inward-lying switch-off position. As a result, the washing means 30 and the lubricating means 40 are switched off.

In a lower region of the framework 14 a center drawer 13 can be provided which can collect dirt from above. The drawer 13 can be emptied at certain points in time.

Figure 4:
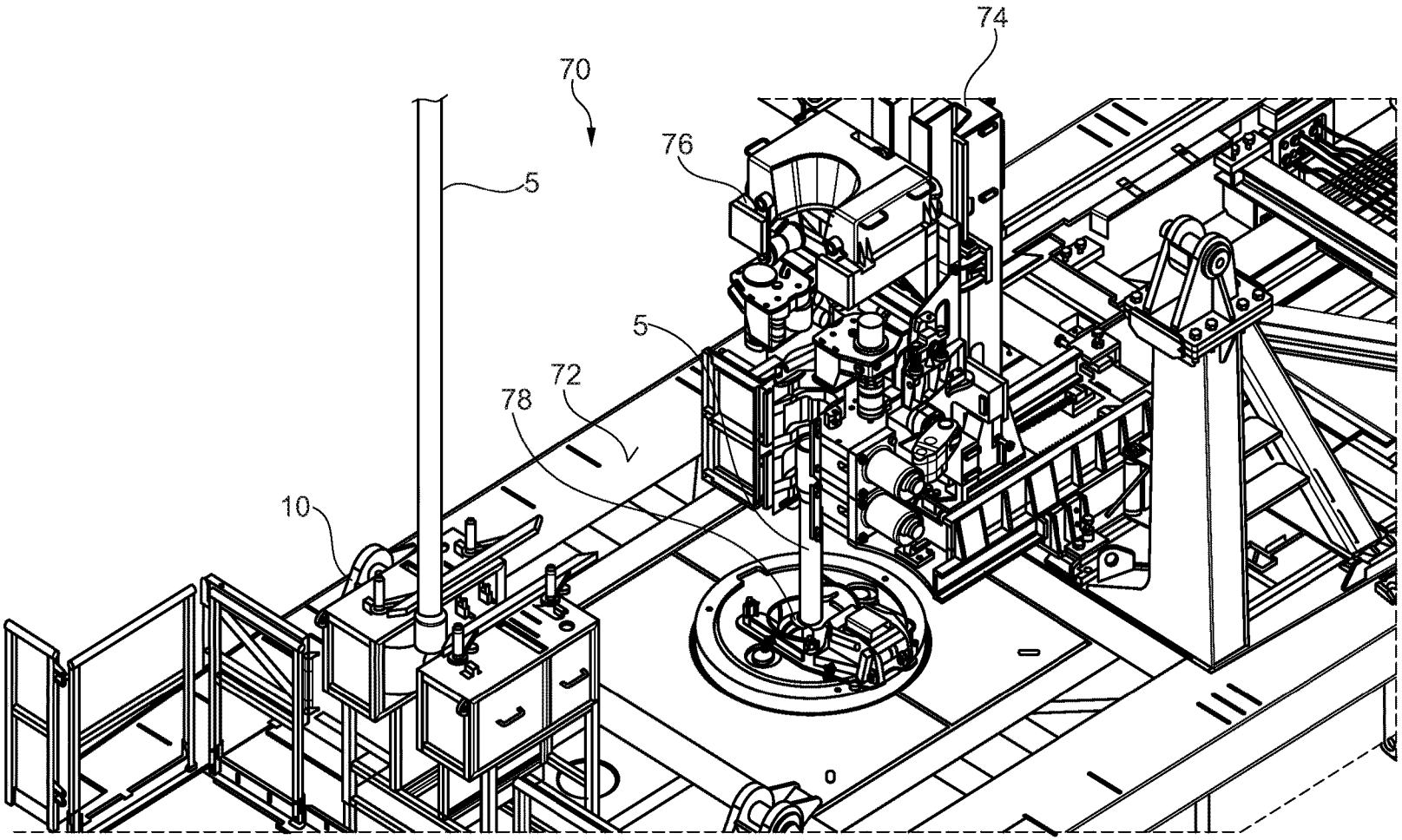
FIG. 4 a perspective partial view of a drilling rig according to the invention with the device according to the invention of FIGS. 1 to 3.

In FIG. 4 a drilling rig 70 according to the invention with a horizontal drilling platform 72 and a drill mast 74 arranged vertically thereon are depicted. The basic construction of a drilling rig 70 which is used e.g. for oil or gas drilling is known. At a borehole 78 a drill string is formed of a plurality of drill rod elements 5 by screwing them together. To this end, generally known tensioning and drive means 76 are arranged along the drill mast 74.

According to the invention, during transport of a drill rod element to or from the borehole 78 a device 10 according to the invention for cleaning and lubricating the drill rod element 5 can be arranged. In this way, a drill rod element 5 can be cleaned or lubricated during transport from or to a drill rod magazine, not illustrated in detail here.

In the illustration according to FIG. 4 a drill rod element 5 initially runs with its lower connecting section 6 through the washing means 30 of the device 10. Afterwards, lubrication takes place by means of the lubricating means 40 in the device 10. In this way, a cleaned and lubricated drill rod element 5 can easily be assembled to the drill string and this with high operational safety.

The invention claimed is:

1. A device for cleaning or lubricating at least a connecting section of a drill rod element, the device comprising:

a housing, a channel-like recess, which extends from at least one side opening in at least one side wall of the housing in a horizontal direction along an upper side of the housing and is configured for receiving at least a connecting section of the drill rod element, and at least one washing device or lubricating device which is arranged along the channel-like recess, wherein the channel-like recess is configured for horizontal insertion of at least a lower connecting section of the drill rod element when the drill rod element is substantially in vertical alignment, and wherein on the channel-like recess a switch device is provided, by which, on entry of the drill rod element into the recess, the washing device or lubricating device is switched on and, on exit from the recess, the washing device or lubricating device is switched off.

2. The device according to claim 1, wherein the switch device has at least one adjustably supported actuating bar, which is adjustable between a switch-off position in the region of the recess and a switch-on position, wherein in the switch-on position the washing device or lubricating device is switched on and in the switch-off position the washing device or lubricating device is switched off.

3. The device according to claim 2, wherein at least two actuating bars are arranged which each run on one side along the channel-like recess.

4. The device according to claim 3, wherein the actuating bars are supported under spring pretension, wherein through the spring pre-tension the actuating bar is pressed into the switch-off position.

5. The device according to claim 4, wherein on entry of the drill rod element into the channel-like recess the actuating bars are adjusted from the switch-off position into the switch-on position.

6. The device according to claim 1, wherein the washing device has at least one washing nozzle which is configured to direct a cleaning jet of a cleaning fluid onto the drill rod element.

7. The device according to claim 1, wherein the washing device has at least one brush driven in a rotating manner for cleaning the drill rod element.

8. The device according to claim 1, wherein the lubricating device has at least one application unit for applying a lubricant at least to the connecting section of the drill rod element.

9. The device according to claim 1, wherein the recess extends transversely across the housing from a first opening in a first side wall to a second opening in a second side wall, wherein on entry of the drill rod element into the recess through the first opening the washing device is actuated and on exit from the second opening the washing device is switched off, and wherein on entry of the drill rod element into the recess through the second opening the lubricating device is actuated and on exit from the second opening the lubricating device is switched off again.

10. A drilling rig with a drill mast, along which at least one drill rod element can be drilled into the ground with a drill drive while a borehole is being formed and withdrawn from the borehole after production of the bore, the drilling rig comprising:

a handling device, with which a withdrawn drill rod element can be received and transported away from the drill mast, and a device for cleaning or lubricating at least a connecting section of the at least one drill rod element, the device comprising:

a housing, a channel-like recess, which extends from at least one side opening in at least one side wall of the housing in a horizontal direction along an upper side of the housing and is configured for receiving at least a connecting section of the at least one drill rod element, and at least one washing device or lubricating device which is arranged along the channel-like recess, wherein the channel-like recess is configured for horizontal insertion of at least a lower connecting section of the at least one drill rod element when the at least one drill rod element is substantially in vertical alignment, and wherein on the channel-like recess a switch device is provided, by which, on entry of the at least one drill rod element into the recess, the washing device or lubricating device is switched on and, on exit from the recess, the washing device or lubricating device is switched off.

11. A method for cleaning or lubricating at least a connecting section of a drill rod element with a device for cleaning or lubricating the connecting section of the drill rod element, the device comprising:

a housing, a channel-like recess, which extends from at least one side opening in at least one side wall of the housing in a horizontal direction along an upper side of the housing and is configured for receiving at least a connecting section of the drill rod element, and at least one washing device or lubricating device which is arranged along the channel-like recess, wherein the channel-like recess is configured for horizontal insertion of at least a lower connecting section of the drill rod element when the drill rod element is substantially in vertical alignment, the method comprising:

inserting a lower connecting section of the drill rod element, which is vertically arranged, through the at least one side opening in the at least one side wall of the housing into the channel-like recess which extends horizontally along an upper side of the housing, cleaning in the channel-like recess at least the connecting section of the drill rod element with the washing device or lubricating in the channel-like recess at least the connecting section of the drill rod element with the lubricating device, causing at least the connecting section of the drill rod element to enter the channel-like recess through a first opening in a first side wall of the housing, moving the connecting section, performing said cleaning or said lubricating of the connecting section along the channel-like recess, and causing the drill rod element to exit from the channel-like recess at a second opening in a second side wall of the housing.

12. The method according to claim 11, the method comprising:

providing a lubricant to the connecting section of the drill rod element after said cleaning.

* * * * *